US009422042B2

(12) United States Patent
Chen et al.

(10) Patent No.: US 9,422,042 B2
(45) Date of Patent: Aug. 23, 2016

(54) CANTILEVERED ROTATABLE CARCASS CARRIER

(71) Applicant: Ship and Ocean Industries R&D Center, New Taipei (TW)

(72) Inventors: Min-Tsung Chen, New Taipei (TW); Tsai-Min Chiang, New Taipei (TW); Chien-Hung Liu, New Taipei (TW); Po-Feng Wang, New Taipei (TW)

(73) Assignee: SHIP AND OCEAN INDUSTRIES R&D CENTER, New Taipei (TW)

( * ) Notice: Subject to any disclaimer, the term of this patent is extended or adjusted under 35 U.S.C. 154(b) by 24 days.

(21) Appl. No.: 14/581,353

(22) Filed: Dec. 23, 2014

(65) Prior Publication Data

US 2016/0176484 A1 Jun. 23, 2016

(51) Int. Cl.

| | |
|---|---|
| ***B63B 1/14*** | (2006.01) |
| ***B63C 11/49*** | (2006.01) |
| ***B63B 3/00*** | (2006.01) |

(52) U.S. Cl.

CPC . *B63C 11/49* (2013.01); *B63B 1/14* (2013.01); *B63B 3/00* (2013.01); *B63B 2001/145* (2013.01)

(58) Field of Classification Search

CPC ..... B63C 11/49; B63C 11/38

See application file for complete search history.

(56) References Cited

U.S. PATENT DOCUMENTS

| | | | | |
|---|---|---|---|---|
| 1,356,773 | A * | 10/1920 | Lake | B63C 11/38 114/322 |
| 4,364,322 | A * | 12/1982 | van Roon | B63B 29/02 114/71 |
| 6,612,251 | B1 * | 9/2003 | Ness | B63B 35/00 114/66 |

* cited by examiner

*Primary Examiner* — Edwin Swinehart

(74) *Attorney, Agent, or Firm* — Ming Chow; Sinorica, LLC

(57) ABSTRACT

A cantilevered rotatable carcass carrier includes a main carcass and two secondary carcasses. The two secondary carcasses are pivotally connected to two sides of the main carcass through two first cantilevers. The secondary carcasses are further pivotally connected with second cantilevers. The secondary carcasses further pivotally connected with an airtight cabin through the second cantilevers. By turning the secondary carcasses, the airtight cabin can be located under the main carcass to form a submarine mode or located above the main carcass to form a watch mode, broadening the recreation space on the water, such that the recreation space on the water is not limited to the type of two-dimensional space on the water. The present invention provides a novel water recreational carrier for the demands of different situations.

5 Claims, 4 Drawing Sheets

CANTILEVERED ROTATABLE CARCASS CARRIER

BACKGROUND OF THE INVENTION

1. Field of the Invention

The present invention relates to a water carrier, and more particularly to a cantilevered rotatable carcass carrier.

2. Description of the Prior Art

A conventional water recreational carrier is limited to the movement of two-dimensional space on the water, so the view and activity range of the water recreation is limited thereto. This also results in limitation of the space and type of recreations on the water. A glass boat is developed for submarine activities under the water to provide more diverse views. The conventional glass boat is provided with windows at the lower cabin or a transparent base. The view range and activity range of this water recreational carrier is limited to the two dimensional space under the water surface. It is unable to go deeper and subjected to the interference of water surface. Accordingly, the inventor of the present invention has devoted himself based on his many years of practical experiences to solve these problems.

SUMMARY OF THE INVENTION

The primary objective of the present invention is to provide a cantilevered rotatable carcass carrier to overcome the problem that the conventional water recreational carrier is limited to the type of two-dimensional space on the water. The present invention provides a novel water recreational carrier, broadening the recreational space on the water in a submarine mode and a watch mode for the demands of different situations.

In order to achieve the aforesaid objective, the cantilevered rotatable carcass carrier of the present invention comprises a main carcass and two secondary carcasses. The two secondary carcasses are pivotally connected to two sides of the main carcass through two first cantilevers and parallel to the main carcass. The secondary carcasses are turned with the first cantilevers as the axles. The secondary carcasses are further pivotally connected with second cantilevers. The secondary carcasses further pivotally connected with an airtight cabin through the second cantilevers. The airtight cabin has a transparent cabin cover, and the transparent cabin cover is adapted to open or close the airtight cabin.

The cantilevered rotatable carcass carrier of the present invention uses the secondary carcasses for the airtight cabin to be located under the main carcass to form a submarine mode or to be located above the main carcass to form a watch mode, broadening the recreation space on the water, such that the recreational space on the water is not limited to the type of two-dimensional space on the water. The present invention provides a novel water recreational carrier for the demands of different situations.

DETAILED DESCRIPTION OF THE PREFERRED EMBODIMENTS

Embodiments of the present invention will now be described, by way of example only, with reference to the accompanying drawings.

Figure 1:
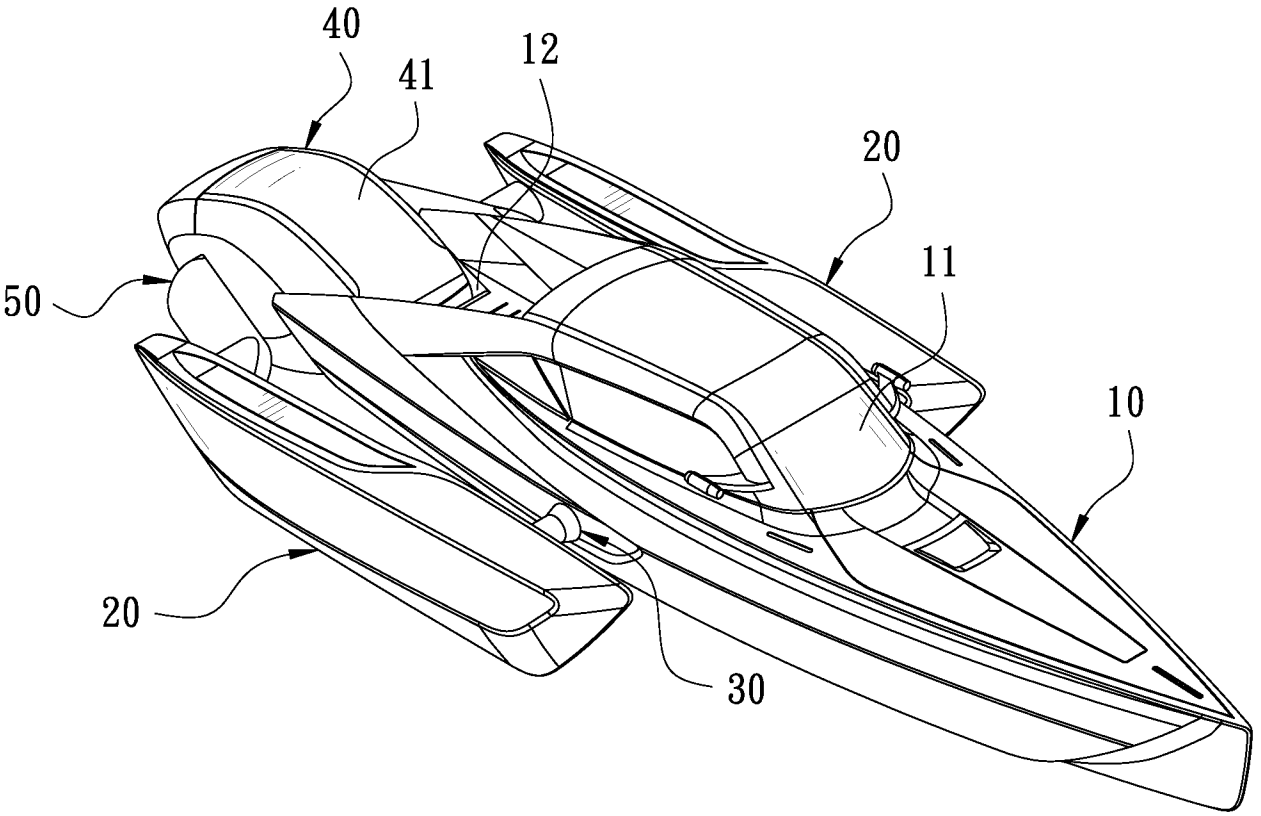
FIG. 1 is a perspective view of the present invention in a rest mode.

FIG. 1 is a perspective view of the present invention in a rest mode. The present invention discloses a cantilevered rotatable carcass carrier. The cantilevered rotatable carcass carrier comprises a main carcass 10, two first cantilevers 30, two secondary carcasses 20, two second cantilevers 50, and an airtight cabin 40.

The main carcass 1 is a carcass having power. The main carcass 1 comprises a cockpit 11. The cockpit 11 is provided with a first control unit therein. The bottom side of the main carcass 10 is provided with an engine and a rudder. The engine and the rudder are connected with the first control unit, so that the engine and the rudder are controlled by the first control unit. The rear of the main carcass 10 further has an anchorage area 12. In this embodiment of the present invention, the main carcass 10 is a mono-carcass yacht to lower R&D cost and production cost so as to enhance the economic benefits.

The two first cantilevers 30 are disposed at two sides of the main carcass 10 and pivotally connected to the center of the gravity of the main carcass 10. The first cantilevers 30 are transversely connected to the main carcass 10. One end of each cantilever 30 is pivotally connected to the main carcass 10, and another end of each cantilever 30 extends toward the outside of the main carcass 10. It is noted that the first cantilevers 30 are axially telescopic. In this embodiment of the present invention, the first cantilevers 30 are operated in an oil hydraulic way and symmetrically pivoted to the middle rear section of the main carcass 10.

The two secondary carcasses 20 are respectively disposed at one end of the main carcass 10, away from the first cantilevers 30, and located at left and right sides of the main carcass 10, enhancing the stability of the cantilevered rotatable carcass carrier and behavior at sea. In this embodiment of the present invention, the length of the secondary carcasses 20 is shorter than that of the main carcass 10. The length of the secondary carcasses 20 is greater than the height of the main carcass 10. The width of the secondary carcasses 20 is narrower than that of the main carcass 10. The two secondary carcasses 20 are disposed at left and right sides of the rear section of the main carcass 10 and parallel to the main carcass 10. The rear sections of the secondary carcasses 20 extend to the left and right sides of the rear section of the main carcass 10. The first cantilevers 30 are pivotally connected to the front sections of the secondary carcasses 20, such that the secondary carcasses 20 can be turned to the left and right sides above the main carcasses 10 or to the left and right sides under the main carcasses 10. Furthermore, through the first cantilevers 30 to extend or retract axially, the secondary carcasses 20 extend outward apart from the main carcass 10 to enhance the stability of the cantilevered rotatable carcass carrier, alternatively, the secondary carcasses 20 are attached to the main carcass 10 to lower the resistance to generate waves for the prow of the cantilevered rotatable carcass carrier.

The second cantilevers 50 are connected to the secondary carcasses 20, respectively. The second cantilevers 50 are transversely connected to the secondary carcasses 20 and parallel to the first cantilevers 30. One end of each secondary cantilever 50 is pivotally connected to the corresponding secondary carcass 20, and another end of each secondary cantilever 50 extends between the secondary carcasses 20. It is noted that the secondary cantilevers 50 are axially telescopic.

The secondary cantilevers 50 are operated in an oil hydraulic way and symmetrically pivoted to the rear sections of the secondary carcasses 20.

The airtight cabin 40 is disposed at one end of the secondary cantilevers 50, away from the secondary carcasses 20, such that the airtight cabin 40 is pivotally connected between the secondary carcasses 20. In this embodiment of the present invention, the airtight cabin 40 is pivotally connected between the rear sections of the secondary carcasses 20 and parallel to the secondary carcasses 20. The airtight cabin 40 is just located at the anchorage area 12 at the rear of the main carcass 10. The airtight cabin 40 has a transparent cabin cover 41. The transparent cabin cover 41 is adapted to open or close the airtight cabin 40. The transparent cabin cover 41 is provided with a second control unit therein. The second control unit is connected with the engine and the rudder, so that the engine and the rudder are controlled by the second control unit.

Figure 2:
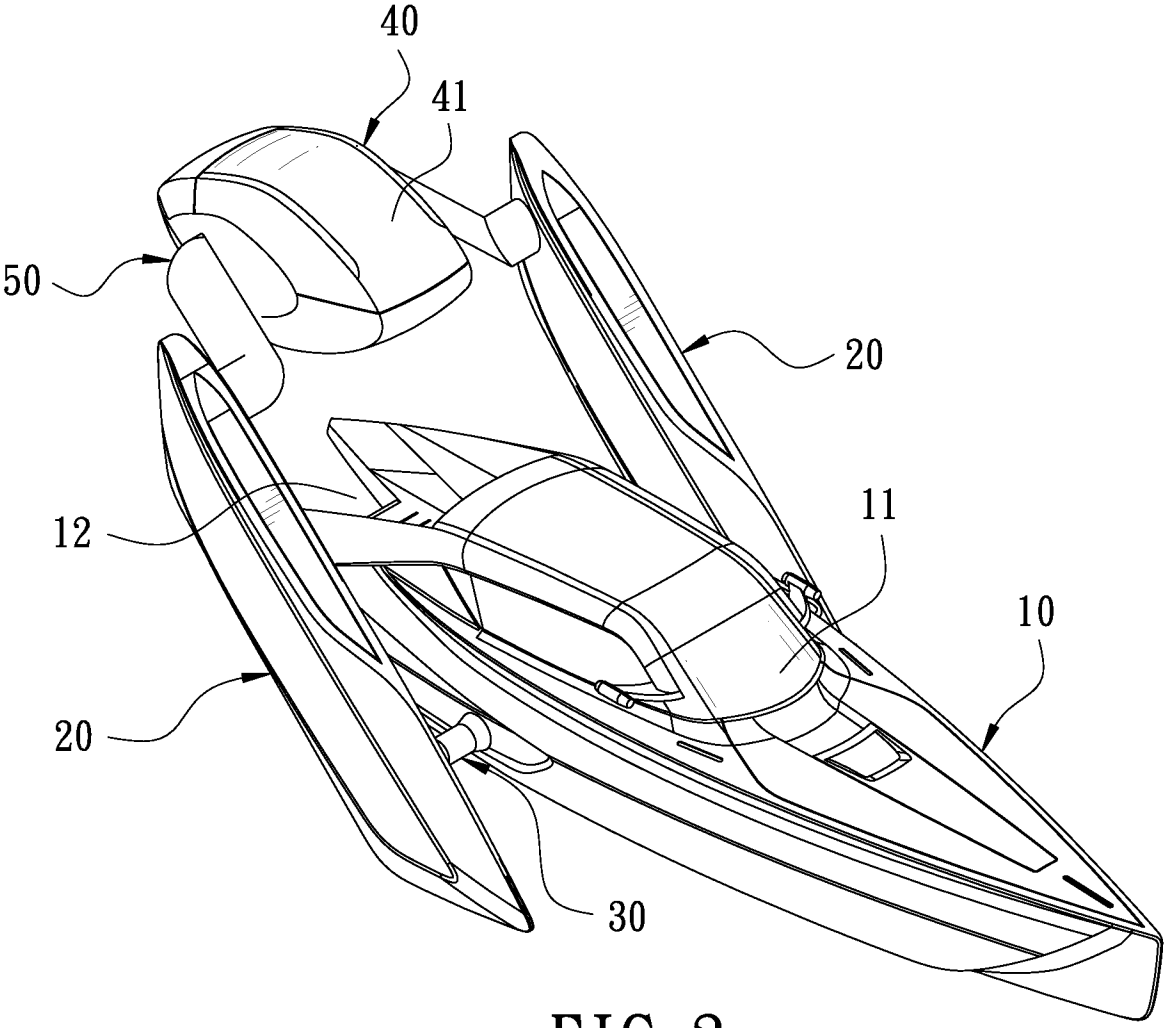
FIG. 2 is a perspective view of the present invention in a watch mode.

FIG. 2 is a perspective view of the present invention in a watch mode. The cantilevered rotatable carcass carrier having three carcasses has the advantages of high stability and high wave-resistant capability and steadiness. The secondary carcasses 20 and the main carcass 10 are connected by the first cantilevers 30. The rear sections of the secondary carcasses 20 are pivotally connected with the airtight cabin 40 which has operation and rest functions. When the secondary carcasses 20 are driven to turn by the first cantilevers 30 for the airtight cabin 40 to ascend above the main carcass 10, the cantilevered rotatable carcass carrier is in a watch mode. At this time, the airtight cabin 40 can overlook water scenery from a high place. The front sections of the secondary carcasses 20 still maintain a certain range of area in contact with the water, continuing to provide buoyancy for keeping the stability and anti-wave capability of the three carcasses formed by the main carcass 10 and the two secondary carcasses 20.

It is noted that the airtight cabin 40 are pivotally connected to the secondary carcasses 20 by the secondary cantilevers 50. Therefore, when the secondary carcasses 20 are driven to turn by the first cantilevers 30, the airtight cabin 40 can maintain its horizontal state, not inclining along with the turning of the secondary carcasses 20. Furthermore, the inclined angle of the airtight cabin 40 can be adjusted by the user through the second control unit, providing more diverse watch angles.

Besides, when the cantilevered rotatable carcass carrier is in a watch mode, the engine and the rudder can be controlled by using the second control unit so as to sail the cantilevered rotatable carcass carrier. At this time, the cantilevered rotatable carcass carrier uses the advantage of three-carcass configuration to provide a stable sailing for water experience at a high place.

Figure 3:
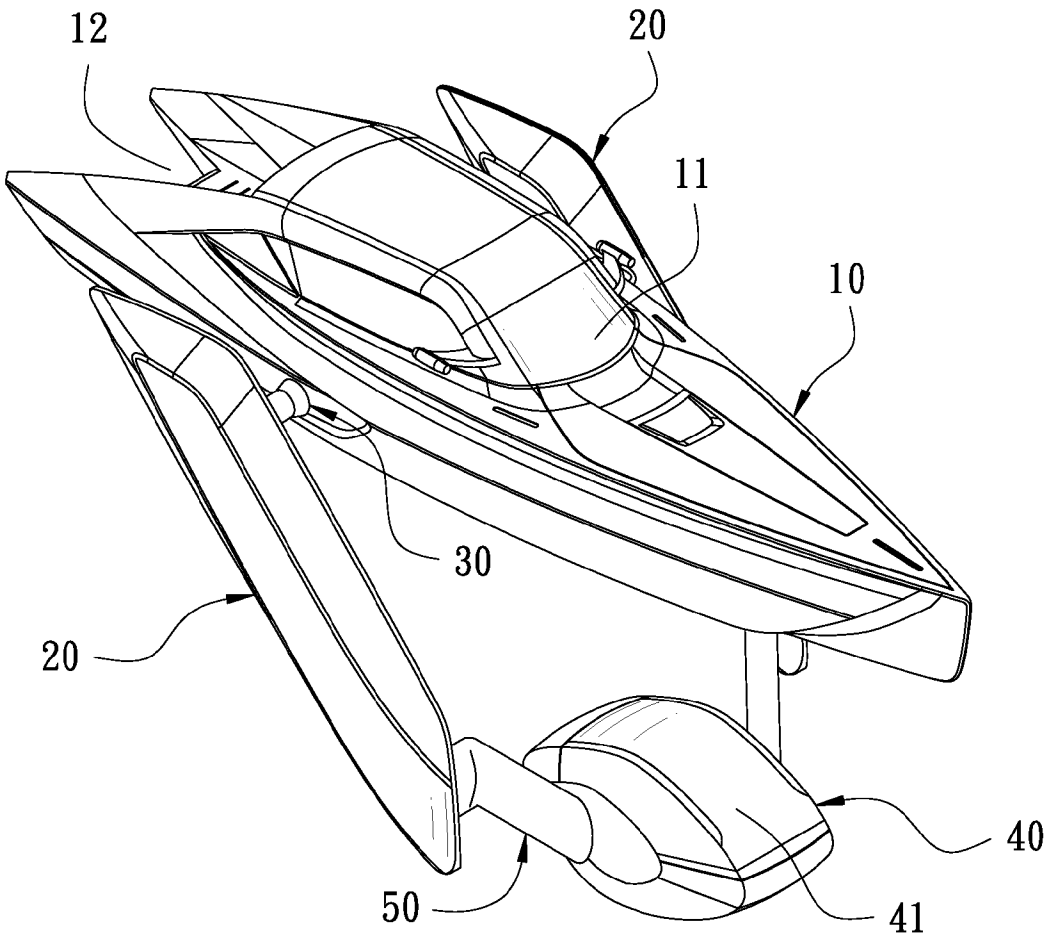
FIG. 3 is a perspective view of the present invention in a submarine mode.

FIG. 3 is a perspective view of the present invention in a submarine mode. When the secondary carcasses 20 are driven to turn by the first cantilevers 30 for the airtight cabin 40 to descend under the main carcass 10, the cantilevered rotatable carcass carrier is in a submarine mode. At this time, the airtight cabin 40 is under the water to operate and control the cantilevered rotatable carcass carrier and to provide a space under the water for rest. Through the large-sized transparent cabin cover 4, the user can watch the special scenery under the water. Through the secondary carcasses 20 connected with the main carcass 10 to provide the essential air, water, electricity, and so on, the user can rest and explore underwater for a long time.

It is noted that the airtight cabin 40 can go deep underwater by using the turning of the secondary carcasses 20. Furthermore, the inclined angle of the airtight cabin 40 is adjustable through the second control unit, providing more diversity. This is different from the view range and activity range of the two dimensional space, avoiding interference of water surface.

It is noted that no matter in a watch mode or in a submarine mode, the cantilevered rotatable carcass carrier uses the secondary carcasses 20 to maintain a certain range of area in contact with the water so as to continue providing buoyancy for keeping the stability and anti-wave capability of the three carcasses formed by the main carcass 10 and the secondary carcasses 20 at two sides. Thus, the cantilevered rotatable carcass carrier in a watch mode or in a submarine mode can have a better action. Furthermore, through the first cantilevers 30 to extend outward in the axial direction, the secondary carcasses 20 extend outward apart from the main carcass 10 to enhance the stability and anti-wave capability of the cantilevered rotatable carcass carrier.

Figure 4:
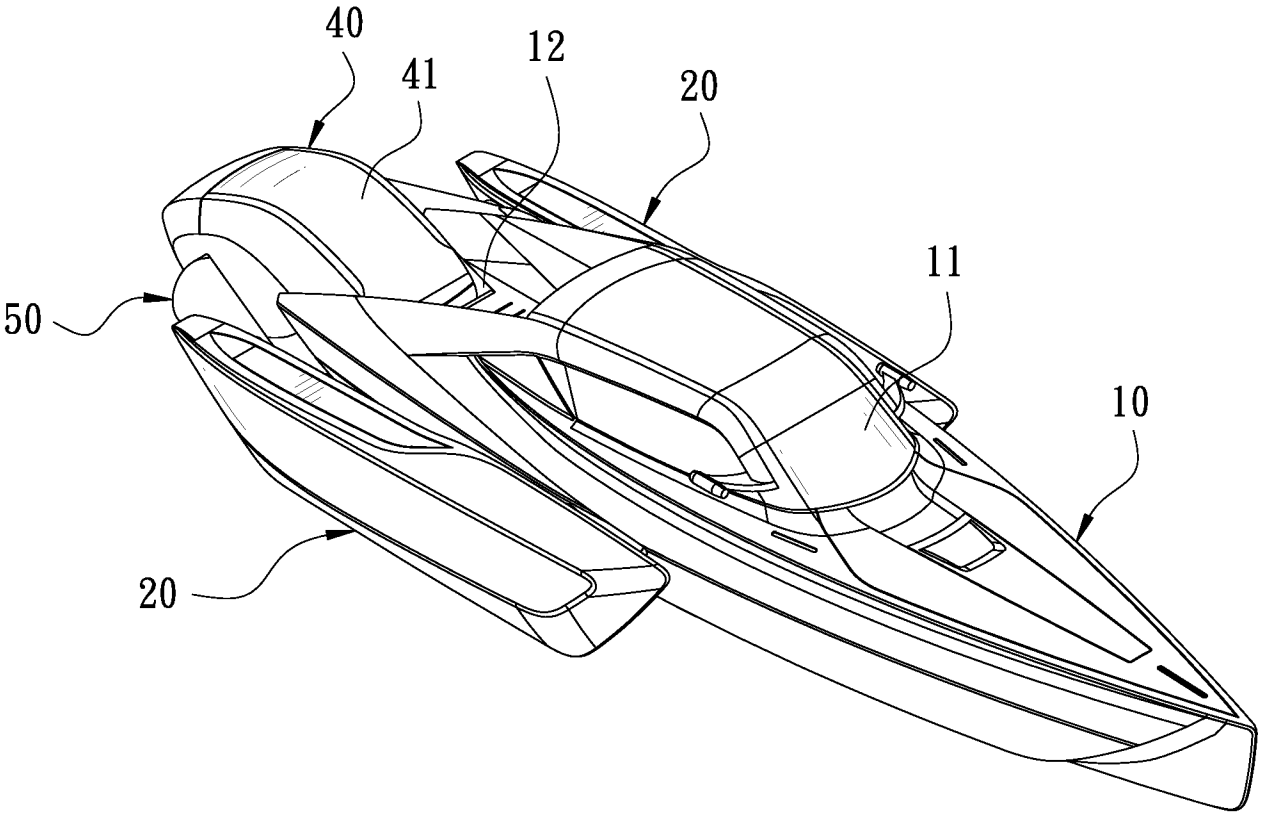
FIG. 4 is a perspective view of the present invention in a cruise mode.

FIG. 4 is a perspective view of the present invention in a cruise mode. As shown in FIG. 1 and FIG. 4, when the cantilevered rotatable carcass carrier performs a cruise, the first cantilevers 30 are retracted axially for the secondary carcasses 20 to attach to the main carcass 10 so as to lower the resistance to generate waves for the prow of the cantilevered rotatable carcass carrier and to enhance the streamline of the cantilevered rotatable carcass carrier. This is beneficial for the cantilevered rotatable carcass carrier to cruise.

It is noted that the pivotal ends of the first cantilevers 30 and the secondary carcasses 20 as well as the pivotal ends of the second cantilevers 50 and the airtight cabin 40 can be pivotally connected in a multi-axis way at different angles.

The features and expected effects of the present invention are described hereinafter.

The cantilevered rotatable carcass carrier of the present invention uses the secondary carcasses for the airtight cabin to be located under the main carcass to form a submarine mode or to be located above the main carcass to form a watch mode, broadening the recreation space on the water, such that the recreation space on the water is not limited to the type of two-dimensional space on the water. The present invention provides a novel movement dimension for water activities, with different modes for the demands of different situations.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A cantilevered rotatable carcass carrier, comprising:

a main carcass, the main carcass having power, a circumferential side of the main carcass being pivotally connected with at least one first cantilever, wherein the at least one first cantilever is able to extend or retract axially so that the secondary carcass selectively extends outward apart from the main carcass or attaches to the main carcass;

at least one secondary carcass, the secondary carcass being connected with the first cantilever and parallel to the main carcass;

at least one secondary cantilever, the secondary cantilever being connected with the secondary carcass, the secondary cantilever being parallel to the first cantilever; and an airtight cabin, the airtight cabin being pivotally connected with the secondary cantilever.

2. The cantilevered rotatable carcass carrier as claimed in claim 1, wherein the secondary carcass is parallel to a rear section of one side of the main carcass, a rear section of the secondary carcass extending to the rear section of the one side of the main carcass, the secondary cantilever being pivotally connected to the rear section of the secondary carcass, wherein when the secondary carcass is disposed horizontally, the airtight cabin is located at the rear of the main carcass, two ends of the first cantilever are pivotally connected with a front section of the secondary carcass, such that the airtight cabin is selectively turned to be located above the main carcass or under the main carcass.

3. The cantilevered rotatable carcass carrier as claimed in claim 1, wherein the rear of the main carcass further has an anchorage area for the airtight cabin to be located at the anchorage area when the secondary carcass is disposed horizontally.

4. The cantilevered rotatable carcass carrier as claimed in claim 1, wherein the airtight cabin has a transparent cabin cover, and the transparent cabin cover is adapted to open or close the airtight cabin.

5. The cantilevered rotatable carcass carrier as claimed in claim 1, wherein the first cantilever is pivotally connected to the center of the gravity of the main carcass.

* * * * *